US010894287B2

(12) United States Patent
Pezzoli

(10) Patent No.: US 10,894,287 B2
(45) Date of Patent: Jan. 19, 2021

(54) DIE-CASTING MACHINE WITH A SYSTEM FOR AUTO-TUNING OF INJECTION VALVES

(71) Applicant: ITALPRESSE INDUSTRIE S.P.A., Capriano del Colle (IT)

(72) Inventor: Andrea Pezzoli, Capriano del Colle (IT)

(73) Assignee: ITALPRESSE INDUSTRIE S.P.A, Brescia (IT)

( * ) Notice: Subject to any disclaimer, the term of this patent is extended or adjusted under 35 U.S.C. 154(b) by 0 days.

(21) Appl. No.: 16/758,635

(22) PCT Filed: Oct. 26, 2018

(86) PCT No.: PCT/IB2018/058377
§ 371 (c)(1),
(2) Date: Apr. 23, 2020

(87) PCT Pub. No.: WO2019/087026
PCT Pub. Date: May 9, 2019

(65) Prior Publication Data

US 2020/0346280 A1 Nov. 5, 2020

(30) Foreign Application Priority Data

Oct. 30, 2017 (IT) ..... 102017000123429

(51) Int. Cl.
*B22D 17/20* (2006.01)
*B22D 17/32* (2006.01)

(52) U.S. Cl.
CPC ..... *B22D 17/32* (2013.01); *B22D 17/203* (2013.01)

(58) Field of Classification Search
CPC ..... B22D 17/203; B22D 17/32; B29C 45/53
See application file for complete search history.

(56) References Cited

U.S. PATENT DOCUMENTS 4,881,186 A 11/1989 Tsuboi et al.
5,662,159 A * 9/1997 Iwamoto ..... B22D 17/32 164/113
5,870,305 A 2/1999 Yokoyama
(Continued)

FOREIGN PATENT DOCUMENTS

EP 2942127 A1 11/2015
GB 2138174 A 10/1984

OTHER PUBLICATIONS

International Search Report, issued in PCT/IB2018/058377, dated Dec. 17, 2018, Rijswijk, Netherlands.
(Continued)

*Primary Examiner* — Kevin E Yoon
(74) *Attorney, Agent, or Firm* — Cantor Colburn LLP

(57) ABSTRACT

An injection assembly for a die-casting machine includes an injection piston for which a desired speed (Vset) is defined during a metal injection step. The piston is moved by an injection delivery valve and an injection drain valve, controlled in opening according to a tuning speed (Vreg). A system of auto-tuning of the opening of the valves is provided. The tuning speed (Vreg) is determined according to the difference between the desired speed (Vset) for the piston and an effective speed (Veff) of the piston, detected for the previous die-casting cycle.

4 Claims, 3 Drawing Sheets

(56) References Cited

U.S. PATENT DOCUMENTS

| | | | | |
|---|---|---|---|---|
| 5,887,641 | A * | 3/1999 | Iwamoto | B22D 17/32 164/155.3 |
| 2001/0044671 | A1 | 11/2001 | Yokoyama et al. | |
| 2004/0033141 | A1* | 2/2004 | Stillhard | F15B 15/1476 417/53 |
| 2014/0314892 | A1* | 10/2014 | Yamaguchi | B29C 45/531 425/149 |
| 2015/0266087 | A1* | 9/2015 | Gnali | B22D 17/2015 222/596 |

OTHER PUBLICATIONS

International Preliminary Report on Patentability for corresponding application PCT/IB2018/058377 filed Oct. 26, 2018; dated Feb. 10, 2020.

Written Opinion of International Search Authority, issued in PCT/IB2018/058377, dated Dec. 17, 2018, Rijswijk, Netherlands.

* cited by examiner

DIE-CASTING MACHINE WITH A SYSTEM FOR AUTO-TUNING OF INJECTION VALVES

CROSS-REFERENCE TO RELATED APPLICATIONS

This application is a National Phase Application of PCT International Application No. PCT/IB2018/058377, having an International Filing Date of Oct. 26, 2018 which claims priority to Italian Patent Application No. 102017000123429 filed Oct. 30, 2017, each of which is hereby incorporated by reference in its entirety.

FIELD OF THE INVENTION

The present invention relates to a hydraulically actuated die-casting machine, in particular for the die-casting of light alloys. In particular, the object of the present invention is a machine injection assembly, equipped with valves for the management of the injection process, provided with an auto-tuning system for opening the injection valves, i.e. the injection delivery valve and/or the injection drain valve.

BACKGROUND OF THE INVENTION

As is known, such machines operate on a die consisting of two die-halves coupling to form the cavity corresponding to the piece to be made and consist of a die closing assembly and an injection assembly provided with an injection piston to pressurize the molten metal poured into the die.

During the injection of the molten metal into the die by the injection piston, there is a first low-speed injection step, necessary to fill the casting channels, and a second high-speed step, necessary to adequately fill the cavity.

To operate the injection piston, an injection delivery valve and an injection drain valve are provided, the opening of which must be carefully controlled to correctly carry out the low-speed step and then the high-speed step.

During the low-speed step, the injection valves are typically controlled in a closed loop, which has an excellent response, since the speed and opening times are relatively low (speed generally <1 meter/second).

The high-speed step (usually 2-7 meters/second) is problematic, because the closed loop controls currently used and especially the dynamics of the valves are not able to react and compensate for the necessary opening of the valves within the established time. As a result, during the high-speed step, the injection piston may have a lower speed than desired. Examples of prior art injection assemblies are disclosed in patent documents GB2138174A, US2001/044671A1. U.S. Pat. Nos. 5,870,305A and 4,881,186A.

SUMMARY OF THE INVENTION

The purpose of the present invention is to create a die-casting machine equipped with an auto-tuning system of at least one of the injection valves able to overcome the problems mentioned above and at the same time meet the needs of the sector.

Such object is achieved by a die-casting machine having the features described below. Further embodiments of the invention are also described.

BRIEF DESCRIPTION OF THE DRAWINGS

The features and advantages of the die-casting machine according to the present invention will be clear from the description given below, provided by way of non-limiting example in accordance with the accompanying figures wherein.

DETAILED DESCRIPTION

Figure 1:
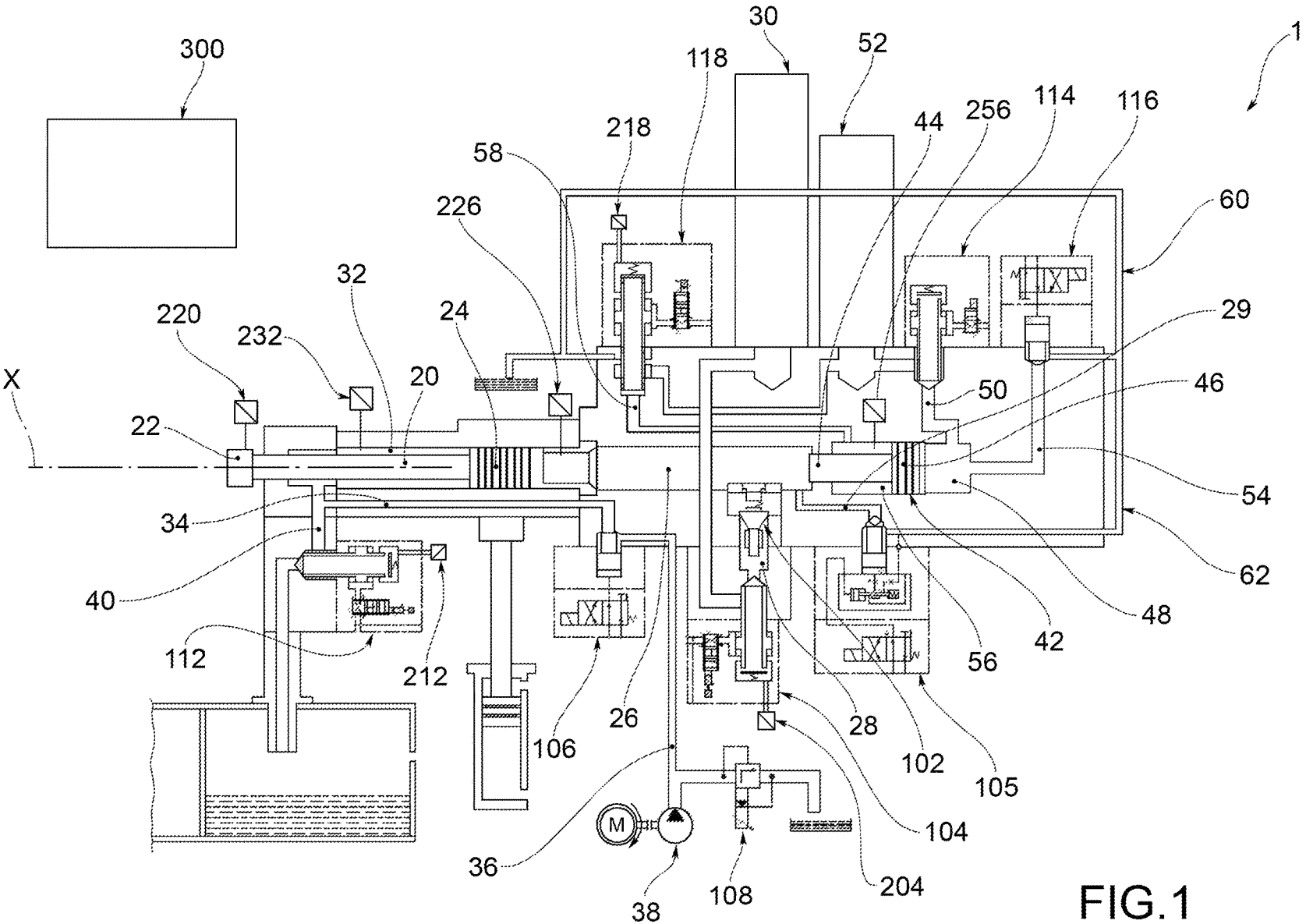
FIG. 1 shows a functional diagram of an injection assembly of a die-casting machine, equipped with valves for managing the process, according to an embodiment of the present invention.

With reference to FIG. 1, an injection assembly of a hydraulically operated die-casting machine is indicated collectively at 1.

The injection assembly 1 comprises an injection piston 20 which extends along a translation axis X between a head end 22 and an opposing tail end 24. The injection piston 20 is translatable on command along said translation axis X by means of a hydraulic drive.

The injection assembly 1 also has a main pressure chamber 26, upstream of the injection piston 20, i.e. upstream of the tail end 24 thereof, for containing and pressurizing the fluid intended for the outward translation of the injection piston 20.

Furthermore, the injection assembly 1 comprises a main fluid inlet 28 and a shut-off valve 102 placed between the main inlet 28 and the main chamber 26 and suitable to prevent the return of fluid from the main chamber 26 to the main inlet 28.

For example, said shut-off valve 102 is made according to the teaching contained in document EP-A1-2942127 in the name of the Applicant.

The machine further comprises a first accumulator 30 (which may be loaded from a relevant cylinder, for example containing pressurized nitrogen) for the injection piston movement circuit 20. Said first accumulator 30 is connected upstream of the main inlet 28, and, between said accumulator 30 and said main inlet 28, a proportional injection delivery valve 104 operates.

Said injection delivery valve 104 is controlled electronically and is feedback-driven by means of a position transducer 204 suitable to detect a signal as a function of the valve opening.

The main pressure chamber 26 is further connected to an injection drain 29 connected to the drain, along which an injection return drain valve 105 operates.

The injection assembly 1 further comprises a main back-pressure chamber 32, downstream of the tail end 24 of the injection piston 20, connected to a return inlet for supplying pressurized fluid for the return translation of the injection piston 20.

The return inlet 34 is connected upstream with a pump delivery 36, upstream of which a pump 38 is located, typically actuated by an electric motor.

An injection return valve 106 is arranged between the delivery pump 36 and the return inlet 34.

Moreover, branching off the pump delivery 36 and connected to the drain, a proportional maximum pump pressure valve 108 is arranged for regulating the pressure at the pump outlet 38.

In addition, the main back-pressure chamber 32 is connected to a return drain 40, connected to the drain, along which is arranged a proportional injection drain valve 112, which is controlled electronically and provided with a position transducer 212, suitable to emit a signal as a function of the opening of said valve.

Furthermore, the injection assembly 1 comprises pressure multiplier means suitable to increase the pressure of the fluid contained in the main chamber 26, above the pressure supplied by the accumulator 30.

Said multiplier means comprise a multiplier piston 42, which extends along a multiplication axis Y, for example, coinciding with the translation axis X of the injection piston 20, between a head end 44, suitable to operate in compression in the main chamber 30, and an opposing tail end 46.

The multiplier piston 42 is translatable on command along the multiplication axis Y.

The pressure multiplier means further comprise a secondary pressure chamber 48, upstream of the multiplier piston 42, and a secondary fluid inlet 50, upstream of the secondary chamber 100, for supplying pressurized fluid.

The machine further comprises a second accumulator (with the relevant recharge cylinder) which is connected to the secondary inlet 50, and between the second accumulator 52 and the secondary inlet 50 a multiplier release valve 114 is placed.

The secondary pressure chamber 48 is further connected to a multiplier return drain 54 connected to the drain, along which is arranged a multiplier return drain valve 116.

Furthermore, the multiplier means comprise a secondary back-pressure chamber 56, downstream of the tail end 46 of the multiplier piston 42, connected to the second accumulator 52 via a secondary return inlet 58.

Along said secondary return inlet 58, between the second accumulator 52 and the secondary back-pressure chamber 56, a main multiplier valve 118 is operative, which is proportional, electronically controllable and provided with a position transducer 218, suitable to emit a signal according to the opening of the valve.

Finally, a first auxiliary portion 60 connects the multiplier return drain valve 116 with the main multiplier valve 118 and is set to drain, and a second portion 62 connects the multiplier return drain valve 116 with the injection return drain valve 105.

Furthermore, the injection assembly 1 comprises:

- an injection piston position sensor 220, for example an encoder, for detecting the position of the injection piston 20;
- a main back-pressure chamber pressure transducer 232, to detect the pressure in the main back-pressure chamber 32;
- a main pressure chamber pressure transducer 226, to detect the pressure in the main pressure chamber 26;
- a secondary back-pressure chamber pressure transducer 256, to detect the pressure in the secondary back-pressure chamber 56.

Figure 2:
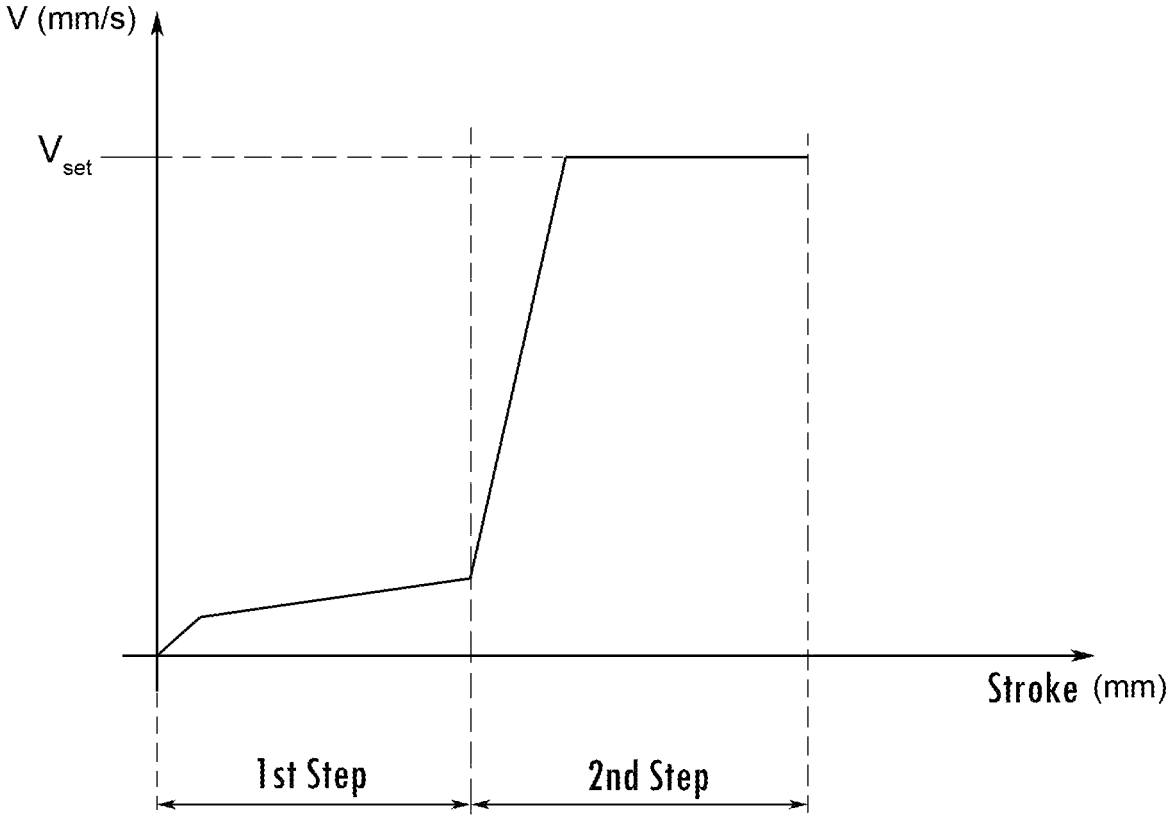
FIG. 2 is a graph that illustrates the trend of the speed of the injection piston, during the first and second injection steps, as a function of the stroke of said piston.

As illustrated in FIG. 2, the die-casting method comprises a first injection step, wherein the injection piston 20 advances at a reduced speed, to allow the molten metal to fill the casting channels provided in the die.

For the first injection step, for a controlled partial opening of the injection delivery valve 104, the pressurized fluid is fed to the main inlet 28, for example at a nominal pressure of 150 bar, and from this to the main chamber 30 as a result of opening the main shut-off valve 102.

By means of the controlled opening of the injection drain valve 112, the main back-pressure chamber 32 is set to drain so that the action of the fluid in the main pressure chamber 30 and the opposite action of the fluid in the main back-pressure chamber 32 generate an outward thrust on the injection piston 20, at the desired speed.

Subsequently, preferably without interruption from the previous step, the method provides for a second injection step, wherein the injection piston 20 advances at a higher speed. For example, it is desired for the injection piston 20 to move at a speed Vset which may reach up to 7 meters/second.

For the second injection step, for a further controlled opening of the injection delivery valve 104, for example total, the pressurized fluid is fed to the main inlet 28 at a greater flow rate and from this to the main pressure chamber 30 as a result of opening the shut-off valve 102.

Moreover, preferably, for the further controlled opening of the injection drain valve 112, the main back-pressure chamber 32 is set to drain so that the action of the fluid in the main chamber 30 and the opposite action of the fluid in the main back-pressure chamber 32 generate an outward thrust on the injection piston 20, at the high speed desired.

Later still, preferably without interruption with the previous step, the method provides for a third injection step, wherein the injection piston acts at almost zero speed, but exerts on the molten metal a high thrust, to force the molten metal, now in solidification, to offset the shrinkage caused by cooling.

For the third injection step, the pressure multiplier means are activated.

In particular, the pressurized fluid is fed to the secondary inlet 50 and from there to the secondary pressure chamber 48 following the controlled opening of the multiplier release valve 114. The secondary back-pressure chamber 56 is fed with pressurized fluid in a controlled manner through the main multiplier valve 118, so that the multiplier piston 42 exerts a thrust action on the fluid present in the main pressure chamber 30, increasing the pressure thereof, for example up to 500 bar.

As a result, the shut-off valve 102, sensitive to the pressure difference between the main inlet 40 and the main pressure chamber 30, passes into the closed configuration, fluidically separating the main inlet 40 and the main pressure chamber 30.

The fluid in the main pressure chamber 30, brought to a high pressure, thus operates on the injection piston 20, so that said piston exerts on the metal in the die the desired action to offset the shrinkage.

After completing the third injection step, the multiplier means are deactivated; in particular, the multiplier piston 42 carries out a return stroke by virtue of the pressurized fluid fed to the secondary back-pressure chamber 56 and the connection to the drain of the secondary pressure chamber 48 due to the opening of the multiplier return drain valve 116.

In addition, the injection piston 20 carries out a return stroke by virtue of the pressurized fluid fed to the main back-pressure chamber 32 through the return inlet 34 and the delivery pump 36 by opening the injection return valve 106, and by the connection to the drain of the main pressure chamber 30 by opening the injection return drain valve 105.

The machine further comprises management means 300, comprising for example an electronic control unit i.e. a programmable PLC or a microprocessor, operatively connected with said valves and/or with said sensors and/or transducers, for controlling the opening and closing of said valves, as a function of the signals emitted by said sensors and/or said transducers and/or as a function of a predetermined management program.

According to the invention, the machine is equipped with an auto-tuning opening system of at least one injection valve, i.e. the injection delivery valve 104 and/or the injection drain valve 112, as illustrated below.

For clarity of presentation, the description below refers to the injection delivery valve, but the invention is also applicable in the same way to the injection drain valve.

For clarity of presentation, moreover, reference is also made below to an injection delivery valve; however, according to the variant embodiments of the invention, several injection delivery valves are provided, each in parallel, and/or several injection drain valves, each in parallel.

Finally, for clarity of presentation, it is assumed that for the execution of an n-th cycle of die-casting, the attainment, during the second injection step, of a set-point speed Vset is provided; said value Vset is entered manually by the operator in the management program or is provided by the same management program.

The self-adjusting system calculates a tuning speed according to the desired speed Vset and a DELTA correction: Vreg=f(Vset,DELTA).

Initially, DELTA at the n-th cycle is null and Vreg=Vset.

The opening of the injection delivery valve 104 at the n-th cycle is regulated according to the tuning speed Vreg (which, as mentioned, at the n-th cycle, is equal to the desired speed Vset).

The machine performs the n-th die-casting cycle, during which, for the second injection step, the injection delivery valve 104 is opened according to the tuning speed Vreg. During the n-th cycle, the mean effective speed Veff reached by the injection piston 20 during the second injection step is defined (for detection by sensors or by calculation on the basis of the position detected by the injection piston position sensor 220).

The auto-tuning system determines the DELTA correction according to the difference found at the n-th cycle between the desired speed and the mean effective speed Veff: DELTA=f(Vset,Veff).

For example, said DELTA correction is equal to the difference in the n-th cycle between the desired speed Vset and the mean effective speed Veff: DELTA=Vset−Veff.

The DELTA correction is used to recalculate the tuning speed Vreg=f(Vset,DELTA), which the auto-tuning system will use for the (n+1)-th cycle.

For example, the tuning speed Vreg=Vset+DELTA.

At the (n+1)-th cycle, the opening of the injection delivery valve 104 during the second injection step is tuned according to the new tuning speed Vreg, which, as may be seen from the above description, depends on the difference found at the n-th cycle between the desired speed Vset and the mean effective speed Veff.

Ultimately, the auto-tuning system according to this invention provides for adjusting the opening of the injection delivery valve 104 during the second injection step of a predefined die-casting cycle according to a tuning speed that depends on the difference between a predefined desired speed and an effective speed measured for the previous die-casting cycle.

Figure 3:
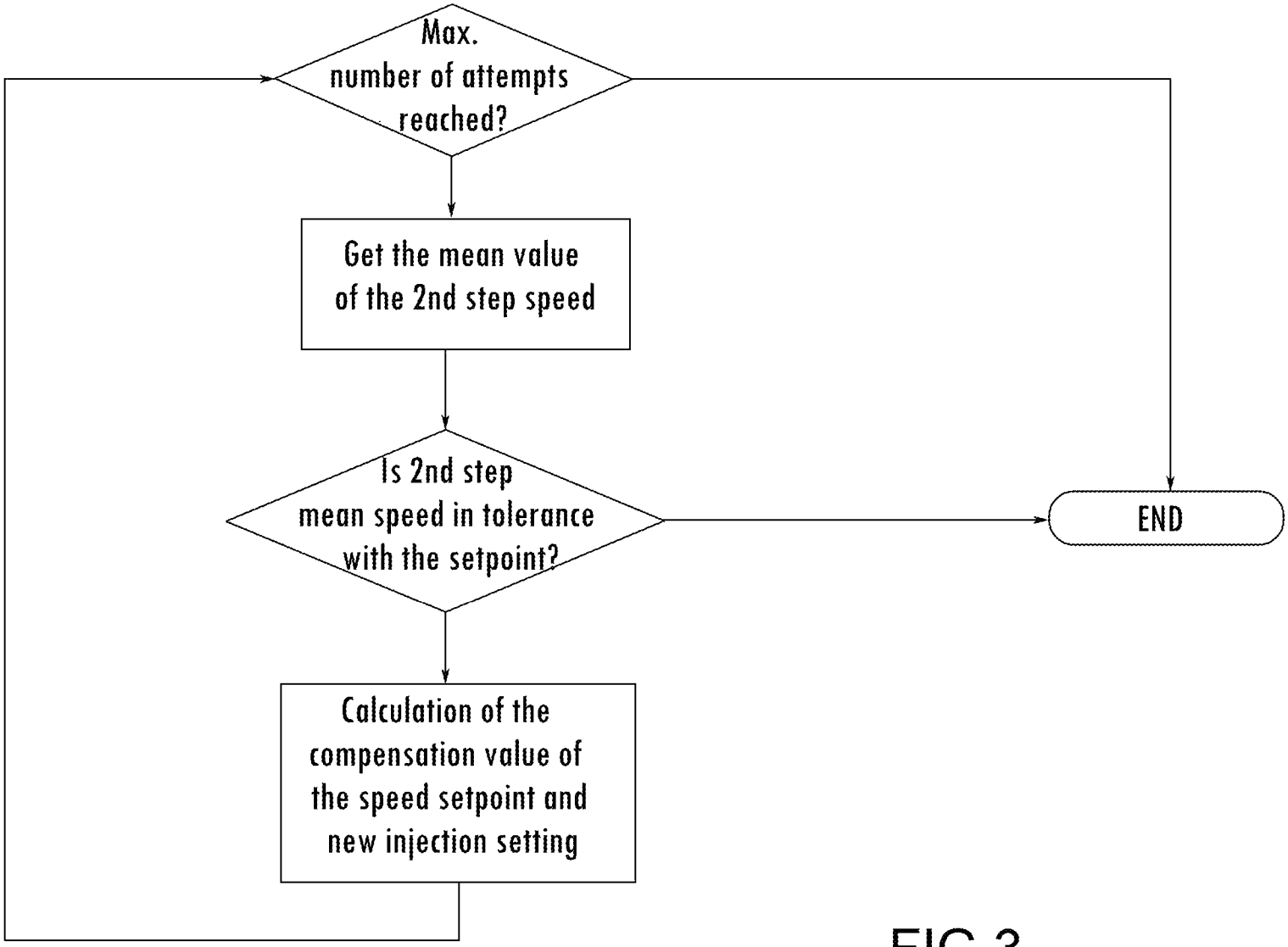
FIG. 3 is a flow chart that illustrates the operation of the system for auto-tuning the opening of the injection delivery valve according to the present invention.

According to an embodiment of the invention, in accordance with FIG. 3, the auto-tuning system provides for the execution of a predefined number of cycles N*, at the end of which a mean correction DELTAdef is defined, used to adjust the opening of the injection delivery valve 104 for the production cycles.

In addition, one may assign to a predefined die the mean correction DELTAdef defined according to the process described above, so that one can use said mean correction later, when the predefined die is reused after a period of inactivity or replacement with another die.

Innovatively, the auto-tuning system for opening the injection delivery valve described above solves the problem described, and in particular allows one to obtain for the injection piston a speed very close to that desired for the second injection step.

It is apparent that one skilled in the art, in order to meet contingent needs, may make changes to the auto-tuning system described above, all contained within the scope of protection defined by the following claims.

The invention claimed is:

1. An injection assembly for a die-casting machine, the injection assembly comprising:

an injection piston controllable in translation to operate on molten cast metal in a machine die for which a desired predetermined speed (Vset) is defined during a metal injection step;

a main pressure chamber, upstream of the injection piston, for containing and pressurizing fluid for outward translation of the injection piston, wherein said main pressure chamber is further connected to an injection drain connected to a drain, along which an injection return drain valve operates;

a proportional injection delivery valve for feeding fluid to a main inlet and from said main inlet to the main pressure chamber as a result of opening of a main shut-off valve;

a main back-pressure chamber, downstream of a tail end of the injection piston, connected to a return inlet for supplying pressurized fluid for return translation of the injection piston, wherein the return inlet is connected upstream with a delivery pump, upstream of which a pump is located;

an injection return valve arranged between the delivery pump and the return inlet;

a proportional injection drain valve for draining fluid from the main back-pressure chamber, so that an action of the fluid in the main pressure chamber and an opposite action of the fluid in the main back-pressure chamber generate an outward thrust for actuation in translation of the injection piston, controlled in opening according to a tuning speed (Vreg);

an auto-tuning injection valve opening system configured so that opening of the auto-tuning injection valve during a predetermined die-casting cycle is tuned according to the tuning speed (Vreg), determined as a function of the difference between said desired predetermined speed (Vset) of the injection piston and an effective speed (Veff) of said injection piston detected for a previous die-casting cycle.

2. The injection assembly of claim 1, wherein the tuning speed for a determined cycle is equal to the difference between said desired predetermined speed and an effective speed measured for the previous die-casting cycle: Vreg=Vset−Veff.

3. The injection assembly of claim 1, wherein said auto-tuning system is operative only during a high-speed injection step.

4. The injection assembly of claim 1, wherein said auto-tuning system operates only for a predetermined number of die-casting cycles, after which is defined a mean correction (DELTAdef) of the desired predetermined speed (Vset) for obtaining the tuning speed (Vreg), said mean correction being associated with said machine die.

* * * * *